US006012997A

United States Patent [19]

Mason

[11] Patent Number: 6,012,997

[45] Date of Patent: Jan. 11, 2000

[54] COMPOUND SAFETY BALL

[76] Inventor: David W. Mason, 800 S. Vandeventer, St. Louis, Mo. 63110

[21] Appl. No.: 09/040,150

[22] Filed: Mar. 17, 1998

Related U.S. Application Data

[60] Provisional application No. 60/041,313, Mar. 19, 1997.

[51] Int. Cl.[7] ..... A63B 41/00

[52] U.S. Cl. ..... 473/594; 473/604; 473/281; 273/DIG. 20

[58] Field of Search ..... 473/594, 595, 473/596, 604, 605, 606, 612, 613, 280, 281, 165; 273/DIG. 20

[56] References Cited

U.S. PATENT DOCUMENTS

| | | | |
|---|---|---|---|
| 3,517,933 | 6/1970 | Malkin | 473/125 |
| 3,633,587 | 1/1972 | Hunt | 473/594 |
| 3,908,994 | 9/1975 | Astrom | 473/613 |
| 4,088,319 | 5/1978 | Clarke | 473/594 |
| 4,986,540 | 1/1991 | Leslie | 473/594 |
| 4,991,847 | 2/1991 | Rudell et al. | 473/594 |
| 5,158,284 | 10/1992 | Vogl | 273/DIG. 20 |
| 5,522,757 | 6/1996 | Ostrowski | 473/594 |

*Primary Examiner*—Steven Wong

[57] ABSTRACT

A compound ball simulates the performance of a regulation size baseball, softball, and golf ball. It is formed of spherical outer and inner shells dimensioned to abut one another or to provide a spacing between them. The outer shell is formed of molded polymeric material with circular apertures spaced over its surface. The inner shell is gas filled and resiliently rebounds in response to being compressed by the outer shell upon deformation of the outer shell in response to being hit, as by a bat or club. The apertures in the outer shell permit air to pass trough the apertures when the compound ball is in flight. The inner shell provides mass and impact rebound within the outer shell for simulating the action of a regulation ball when thrown, caught, hit or impacts an object. The outer shell may also contain raised dimpling to impart greater aerodynamic drag on the compound ball, further limiting its flight and range, or altering its performance.

10 Claims, 4 Drawing Sheets

COMPOUND SAFETY BALL

This application is based on provisional application Ser. No. 60/041,313, filed Mar. 19, 1997, entitled COMPOUND SAFETY BALL of the present inventor.

BACKGROUND OF THE INVENTION

1. Field of the Invention

The invention relates to the field of balls for sports including baseball, softball and golf, and more particularly, concerns a compound safety ball which is realistically and especially practically useful in such sports, especially for training, development and practice but has safety characteristics and superlative characteristics simulative of regulation-type balls.

2. Related Art

In the training of young athletes such as in league baseball, there is a need to train these athletes with realism. Thus, players need to learn the "heft," feel and sound of a baseball or fast-pitch or slow-pitch type softball when throwing, hitting or catching the ball. At the same time, there is a desire to introduce players to these sports safely and to avoid intimidating the young player. The regulation baseball truly can be very intimidating, especially to the young, uninitiated player. Moreover, to be struck through accident or inadvertence or ineptness by a regulation baseball, for example, can be so dangerous and so frightening that the young athlete may always after that have a degree of fear of the ball, and thus be "ball shy" to such an extent that it interferes with development of the player's skill level and confidence.

There is accordingly a need to provide a suitable training or practice ball for baseball players, particularly during their younger years, wherein the ball will be a regulation-simulative ball yet can be used for indoor and outdoor coaching, training, and play by baseball players, without danger of breaking a window or causing other damage. It is further desired that such a ball have intrinsic safety with such characteristics that it that it can safely strike a player in the head or chest without injury, and be safe for use around younger players, especially during their initial training.

It has been known for many years to provide balls which have limited range or limited mass, but are nevertheless not useful in the simulation or actual use of sports. An example is the well-known perforated ball available for many years in the marketplace which is of hollow, molded polyethylene or similar low-cost polymer, in which circular apertures are formed so that the ball will have very high aerodynamic drag. For example, a hollow, perforated ball, being of very low mass, with greatly reduced range has been commercially available under the trade name or designation "WIFFLE." It is considered to be part of the known art, and will here be referred to as a hollow, perforated polymer ("HPP") ball. An HPP ball has such low mass that it prevents a child from being injured by impact. It is not, however, a useful ball for actual sports, for it is far too light and far too limited in range. The HPP ball is useful merely for use in small rooms, or in games for children, or for frivolous, playful or trivial use by persons of any age.

Moreover, regulation balls travel a very great distance when hit. In ball practice, this can present a problem of hitting balls outside a ballpark, for example, and can stretch practice time intervals required during "shagging" of balls.

With regard to regulation-size softballs, such as those of smaller diameters, there are similar considerations and needs.

Other sports are believed to have similar needs. In golf practice, for example, it would be desirable to have practice balls that can be hit realistically with the usual sound and feel produced by club head contact of the ball resulting from a proper stroke, and yet which will travel a reduced distance. And, if such a practice ball were to strike a person, there would be less likelihood of injury to the person struck than by a regulation ball.

There have been a myriad of ball designs employing resilient material for softening the impact of the ball.

For example, U.S. Patents Stillinger U.S. Pat. No. 5,413,331, Watson et al. U.S. Pat. No. 5,007,639, Song U.S. Pat. No. 4,880,233 and Wexler U.S. Pat. No. 4,738,450 all relate to attempts to make balls which are softer, more yieldable, or which give better safety for use with young or inexperienced players. The same is arguably true also of the balls of Tomar et al. U.S. Pat. No. 4,660,830 and Ventura U.S. Pat. No. 4,598,909.

U.S. Pat. No. 4,529,200 to Miller is also noted as disclosing a ball having a spherical shell which is isolated from a preformed core by an anti-bonding agent. Ordinary leather cover surrounds the ball. So also, there is noted Kumasaka et al. U.S. Pat. No. 4,463,951 describing a ball with a PVC outer layer separated from a polyurethane inner body by a water resistant film. Morgan U.S. Pat. No. 4,462,589 has a composite safety ball with a foam core surrounded by a heavy, tightly knit cover, again for safety reasons but has disadvantages. U.S. Pat. No. 4,415,154 to Engelhardt and U.S. Pat. No. 3,908,994 to Astron go to the concept of balls having a large hole pattern. None of these patents are believed to have aerodynamic qualities or regulation ball-simulative characteristics to satisfy the present requirements and objectives.

Among foreign references, French patent 2,504,019 discloses a hollow ball that has another hollow ball inside it. A space between these two is filled with a liquid to allow the inner ball to turn independently of the other. Or the space can be filled with a solid material. An interesting 1989 Soviet Union patent No. 1711929A1 Kesariiskii appears to contemplate a patterned outer ball which is optically transparent, and it contains an inner shell which has its own pattern and can move relative to the outer shell, so that color patterns change as the inner shell moves. A Canadian patent 493,100 to Roberts constitutes what appears to be a baseball but contains a soft core.

None of the balls revealed in these references is believed to have aerodynamic qualities or regulation ball-simulative characteristics or have the combination of features necessary to meet the present requirements and objects.

SUMMARY OF THE INVENTION

A compound ball of the present invention is designed to overcome the foregoing limitation and to solve the needs for a safe, low-cost, training ball which gives the desired action and feel and provides other characteristics of a regulation ball.

The new ball has satisfactory high intrinsic safety and impact characteristics so that if a player or other person were struck in the head or chest, the compound ball would impact without injury, and so is safe for use around younger players, especially during their initial training.

Because this compound ball is relatively light in overall weight it provides relative assurance that there will be no injury upon contact with a player, as when caught, or if it should strike the player. The new compound ball introduces the young players to the effect, feel, and action of a baseball in a non-threatening manner, and more quickly develops baseball handling skills.

Briefly, the new compound ball simulates the performance of a regulation size baseball, softball, or golf ball. It is formed of spherical outer and inner shells, dimensioned to provide a spacing between them. Alternative forms of the compound ball reduce the spacing between the shells to impart different aerodynamic and flight characteristics to suit the application. The outer shell is formed of molded polymeric material with circular apertures spaced over its surface. The inner shell is gas filled and resiliently rebounds in response to being compressed by the outer shell upon deformation of the outer shell in response to being hit by a bat. The apertures in the outer shell permit air to pass trough the apertures when the compound ball is in flight. An alternative form provides raised dimpling on the outer surface of the outer shell to affect the aerodynamic performance of the compound ball. The inner shell provides mass and impact rebound within the outer shell for simulating the action of a regulation ball when thrown, caught, hit or impacts an object.

It is preferred the outer shell be perforated polymer surrounding and enclosing the inner shell, which may be like a tennis ball, and with the spacing between them such that there is permitted relative movement between the inner and outer shells and with the inner shell being suspended lightly by means of a filamentatious coating of the inner shell within the outer shell. The spacing between the shells not only allows air to circulate there for limiting the range of the compound ball but also allows deformation of the outer shell upon impact, as by a bat, to achieve the feel of a solid hit while resulting in a ball that does not injure when caught or upon striking a player or spectator. The spacing between the outer shell and inner shell can be reduced so that the shells dimensionally approach one another across their spherical form. Additionally, the filamentatious coating on the inner shell can be reduced or omitted to change the aerodynamic performance of the compound ball.

Other objects or advantages will be apparent or are pointed out in the following description.

BRIEF DESCRIPTION OF DRAWINGS

Corresponding reference characters identify corresponding elements throughout the several views of the drawings.

DESCRIPTION OF INVENTIVE EMBODIMENTS

Figure 3:
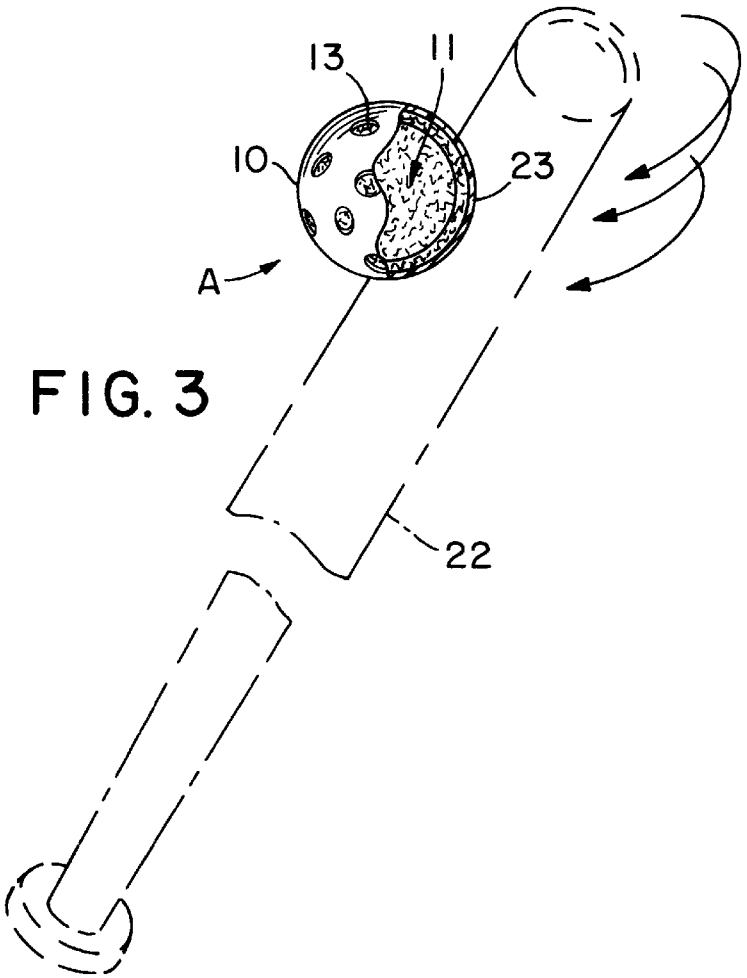
FIG. 3 is a view of the compound ball, its outer shell being cut away for illustrative purposes, as the ball is being struck by a baseball bat, and with deformation of elements of the ball occurring as a result of the impact of the bat.
Figure 1:
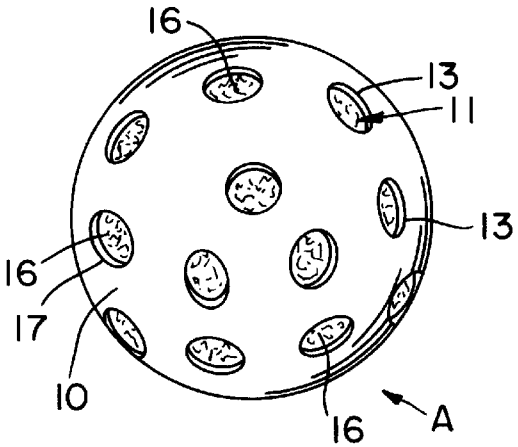
FIG. 1 is perspective view of a compound ball in accordance with and embodying the present invention, as developed for providing a training baseball of size closely approximating a regulation baseball.
Figure 2:
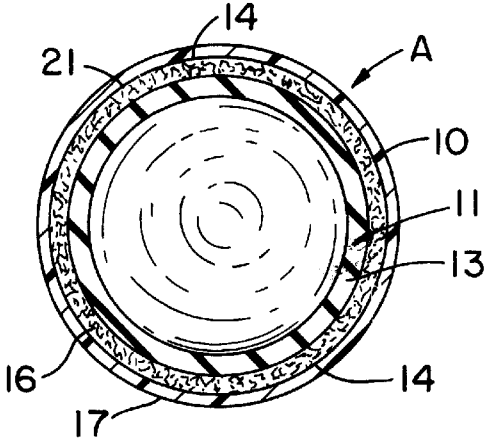
FIG. 2 is a cross-section through the compound ball of FIG. 1.

Referring to FIGS. 1–3 of the drawings, a first embodiment of a compound ball of the invention is designated A. With reference especially to FIG. 2, the compound ball includes an outer shell 10 and an inner shell generally designated 11. Outer shell 10 is formed of molded polymeric material, such as low density polyethylene (LDPE) or other suitable thermoplastic or otherwise moldable synthetic resin material and other possible polymers and copolymers, as formed around inner shell 11 in a molding process, or by joining separate halves of outer shell 10 and joining them by ultrasonic welding. Other impact-resistive polymers such as "Lexan", nylon and various other durable, yet resilient types might also be used.

Outer shell 10 is provided with circular apertures 13 over the surface entirety of its spherical form, and with the apertures created, for example, during a molding process. Inner shell 11 is comprised of a highly resilient rubberized or other highly softly resilient, flexible material, such of flexible laminate or other elastomer, or otherwise softly resilient, flexible moldable synthetic resin material and other possible polymers and copolymers, and defines a hollow interior 14 which is filled with nitrogen to a predetermined pressure in order to define a preselected degree of resiliency of the inner shell to permit spring-like compression and rebound of inner shell 11 when it is compressed by the outer shell 10 under circumstances described later.

Inner shell 11 is provided with a filamentatious cover 16 such characterized by filaments which make up the cover, which may be of felted or woven material, such as polyacrylate, so that the cover is of a decidedly hairy or fuzzy character with randomly oriented filaments 17 extending in indefinite directions outwardly from the surface of the cover.

Outer shell 10 and inner shell 11 are so dimensioned as to define an air space 19 of predetermined radial extent between them, which air space tends to be at least partly but not entirely filled by the filamentatious cover 16 of inner shell 11. Alternatively, outer surface 16*a* of inner shell 11 may be partly or wholly without the filamentatious cover 16, depending upon the desired aerodynamic performance of the compound ball. In general, the filament length and filament presence (or not), and character may be varied or chosen to impact preselected aerodynamic and impact characteristics appropriate for skill level, mass, and intended action and play style of the new compound ball.

Exemplarily, the numerous apertures 13 of outer shell 10 are closely spaced and each may be about 0.25 inch (6.4 mm) in diameter, on centers of about less than 1 inch (25.4 mm).

The fuzzy cover 16 of inner shell 11 provides a cushioning material which keeps inner shell 11 out of contact with an inner surface 21 of outer shell 10. Joined halves (as joined by ultrasonic welding), such as of a known resilient polymer (e.g., low-density polyethylene "LDPE") or other impact-resistive polymers such as "Lexan", nylon and various other durable, yet resilient types.

Examplarily, the outer diameter of the inner shell 11, with its cover, may be about 87% of the outer diameter of outer shell 10, such as 73.025 mm; and the internal diameter of the outer sphere or ball 3 may be 69.85 mm, for example, so that there is an air space in such example of 3.175 mm, so that some relative movement of inner shell 11 within outer shell 10 is permitted, but also so that air can circulate in air space 19 as the ball travels, by passing in and out of apertures 13 with circulation limited only by the hair-like filaments 17 of the inner sphere cover 16 and by and the radial spacing within space 19 and the dimensions of apertures 13.

Of course, outer shell 10 when struck may deflect inwardly into the air space 19 between the two shells, as shown in FIG. 3, but the resilient outer shell returns to its original orientation as the ball travels in flight.

As a practical expedient, as compound ball A is of baseball size, inner shell 11 and its cover 16 may be provided by using a tennis ball, which provides exterior dimensions comparable to the task and includes a filamentatious covering useful for the present purposes. Around such a tennis ball, which may be inflated to predetermined pressure, halves of outer shell 10, each premolded with apertures 13, may be placed and then ultrasonically welded together to form a unitary spherical construction. A representative thickness of outer shell 10 is 1.875 mm, and a representative thickness of inner shell 11 is 10.32 mm.

Referring to FIG. 3, compound ball A is depicted as being struck by a baseball bat 22. Outer shell 10, being resilient, is impacted in an impact area 23 which is flattened or deformed radially inwardly. The resultant deflection inwardly continues until outer shell 10 compresses the cover 16 of inner shell 11, which is in term compressed and deflects accordingly inwardly against the resilient force of nitrogen (or other suitable gas) within inner shell 11, which thus not only provides mass but also impact rebound within the outer shell for simulating the action of a regulation ball when thrown, caught, hit or impacts an object. Thus, inner shell 11 will impart to a batter a satisfying rebound as compound ball A is struck. As a consequence the new compound ball can be hit with the recognizable sound and feel of a regulation baseball. In addition, the tough, resilient outer shell 10 provides a resounding "crack" when struck. Thus, when hit, it gives a solid feel upon impact by the bat, which is readily imparted to the player through the bat for complete tactile and reactive sensation which can only contribute to batting prowess and power.

Although a well-hit will travel a very substantial distance, the distance will be substantially less than a regulation baseball would travel. In fact, the new compound ball is capable of being thrown over appreciable distances, such as up through 100–150 feet, and when struck by a bat, the hitting effect of the new ball is very much simulative of the actual feel of striking a baseball; and additionally, the ball when struck will travel up to about 150 feet. In batting practice it can be best be used in the same manner, but much less time will be spent "shagging" the balls as they are hit, because they typically will not go deep into the outfield. The air space 19 helps limit the ball's range.

Therefore, compound ball A provides a greatly improved training ball for baseball players, particularly during their younger years, and provide a regulation baseball-simulative ball useful for indoor and outdoor coaching, training, and play by baseball players, without danger of breaking a window or causing other damage.

Moreover, as inner shell 11 is gas-filled, the new compound ball is light in weight and can strike a player in the head or chest without injury, and so is safe for use around younger players, especially during their initial training. Because of its light weight and the assurance of not being injured when a player is struck with the ball, these young players are introduced to the effect, feel, and action of a baseball in a non-threatening manner, and so more quickly develop baseball handling skills.

The compound ball can be pitched exactly as if it were a baseball, being of approximately the same outer dimensions, and with comparable aerodynamic characteristics as a regulation baseball, except that it exhibits greater aerodynamic drag than a regulation baseball. Because it has good aerodynamic characteristics, it may be thrown straight, or it may be thrown with a deliberate curve, drop, or other aerodynamic affect produced by spin control.

Even with these advantages and satisfying impact, as well as good effect when caught with normal glove-handling skills, the young player will not be threatened or injured even if struck by the ball, and thus is not intimated even when the ball comes in at a high velocity. On the contrary, because of the resounding smack of the new compound ball against the glove, and its simulative heft and kinetic energy when caught from a high speed pitch or bat hit, the compound ball of the invention provides a learning experience highly simulative of a regulation baseball.

It is yet to be fully explored and elucidated why the new ball feels so much like a baseball. However, it is believed that the relative movement of the inner shell 11 within the outer shell 10 its resilience support therein because of the filamental character of cover 16, and the deformation produced by striking of the outer shell 10, all tend to give an impact, with rebound aided by the gas in the inner ball, which impact is very much similar to that of a baseball but not nearly so threatening or dangerous.

Figure 5:
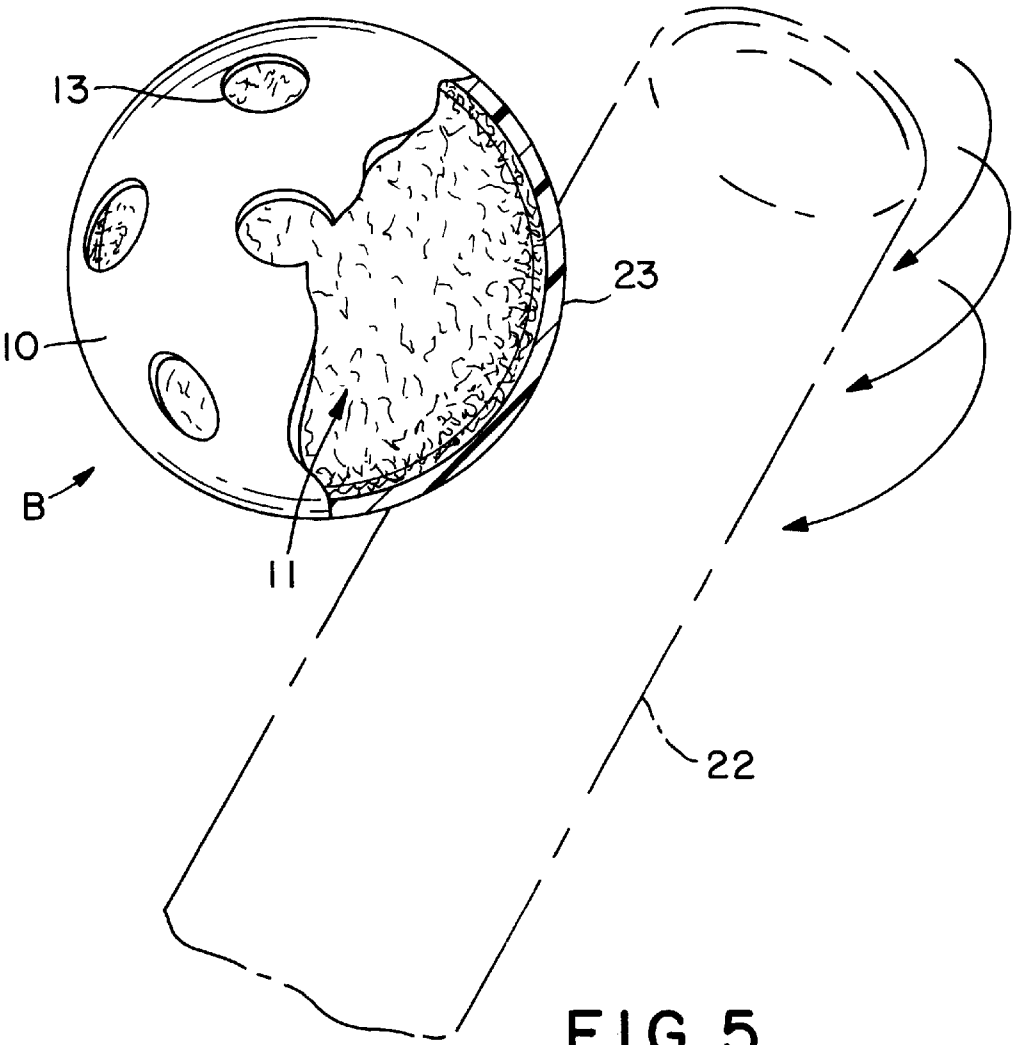
FIG. 5 is a view of the compound ball of softball size, its outer shell being cut away for illustrative purposes, as the ball is being struck by a softball bat, and with deformation of elements of the ball occurring as a result of the impact of the bat.
Figure 4:
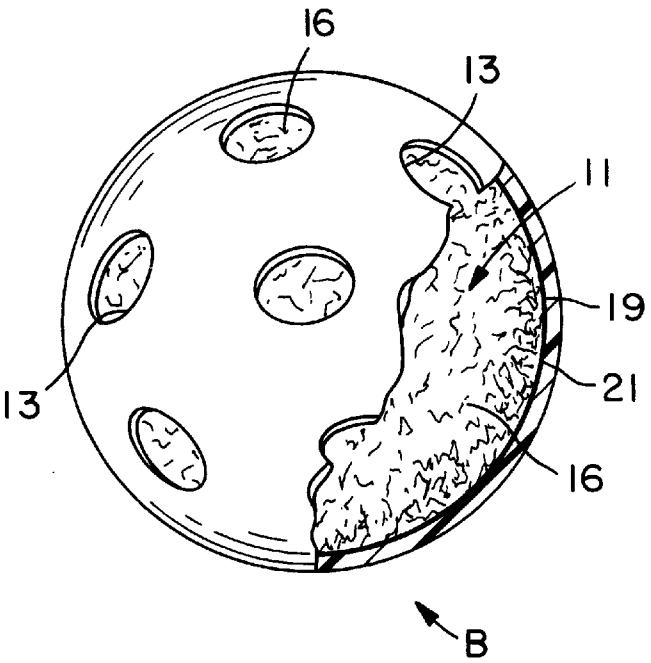
FIG. 4 is a view of another embodiment of a compound ball of the invention, as developed for providing a training softball of size closely approximating a regulation softball, and with its outer shell being cut away for illustrative purposes.

Referring to FIGS. 4 and 5, a softball-sized embodiment of a compound ball of the invention is designated as embodiment B. It similarly includes an outer shell 10 and an inner shell 11, of materials like those described for embodiment A, and similarly constructed. Although inner shell 11 is depicted with filimentatious cover 16, outer surface 16*a* of inner shell 11 may be wholly or partly without the filamentatious cover 16, depending upon the desired aerodynamic performance of the compound ball. Thus, as in the embodiment A of FIGS. 1–3, the filaments of the cover may be reduced in length or even omitted or may instead be constituted by texturing of the inner ball's surface, depending on the aerodynamic effect and impact effect desired.

Although outer shell 10 is formed similarly with circular apertures 13, their number may be the same (such as a total of 26 apertures), so that there is relatively greater surface area of outer shell 10 and proportionately lesser total area of the apertures, with accordingly less aerodynamic drag produced as the ball moves through air upon being thrown or hit. Although being larger and slower than the baseball-sized compound ball A, the softball version compound ball B provides a natural feel during throwing, catching and batting, being simulative of a regulation softball, yet assuring against injury and inducing confidence especially in young plays, so that they rapidly may progress to sport using regulation softballs. So also, for batting practice, the compound soft ball according to the present disclosure reduces the hitting distance.

Moreover, as in the case of a baseball size compound ball of the invention, these new compound balls are manufacturable with extreme economy and rapidity. Therefore, their use in great numbers is economical even for sports organizations, as in schools, clubs and amateur leagues, which organizations may for one reason or another have a most limited budget. Because the new balls are so economical, many more practice balls of the presently disclosed type can be purchased than regulation balls. In batting practice, then, as an example, large numbers of the balls can used for greater exposure of batters to pitches, as well as making it possible to replicate hitting or practice facilities more readily because of the economy of doing so made possible through minimizing purchase of regulation balls.

Figure 7:
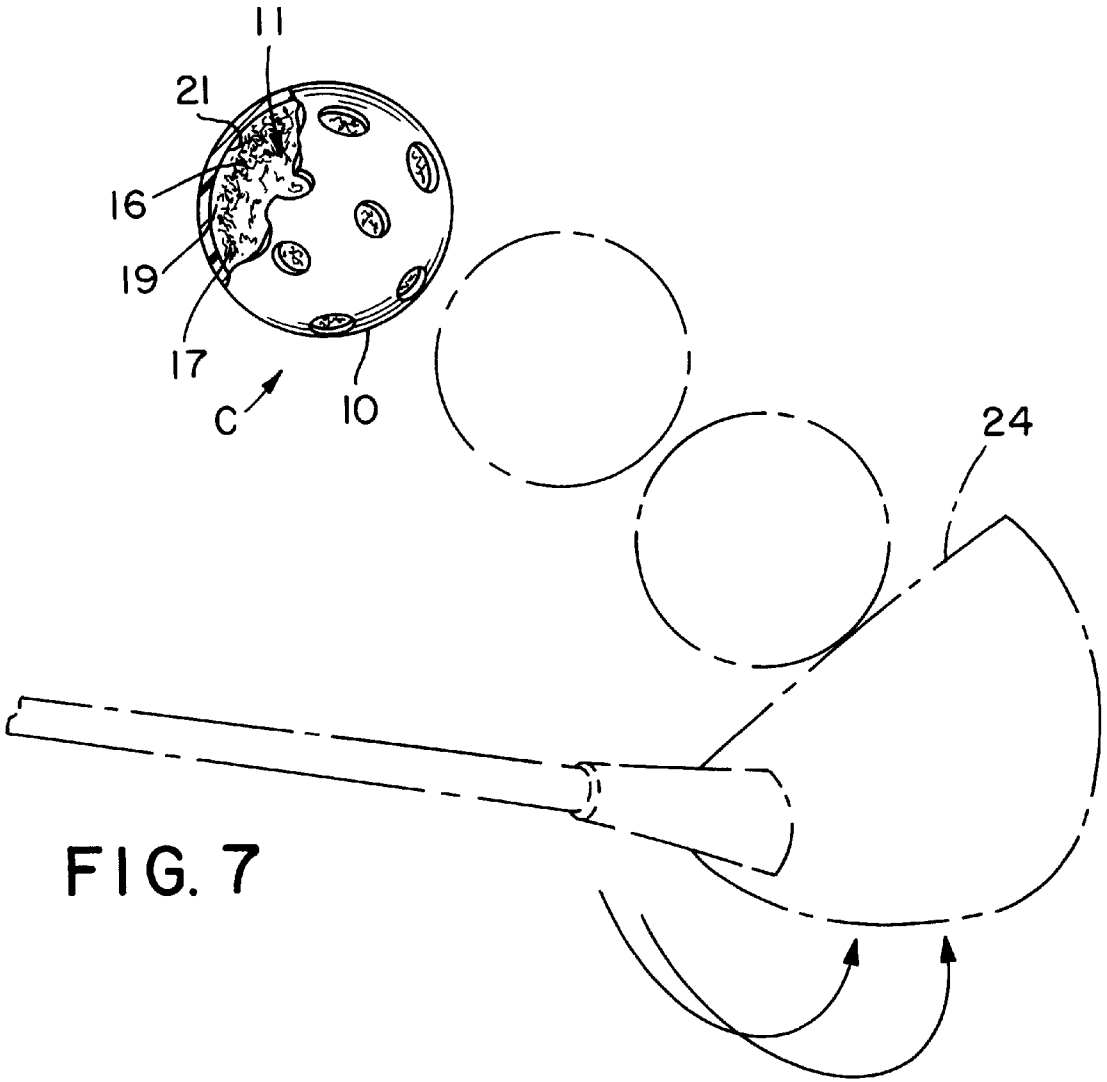
FIG. 7 is a view of the compound ball of golf ball size, its outer shell being cut away for illustrative purposes, as the ball is being struck by the head of a golf club, and with deformation of elements of the ball occurring as a result of the impact of the head.
Figure 6:
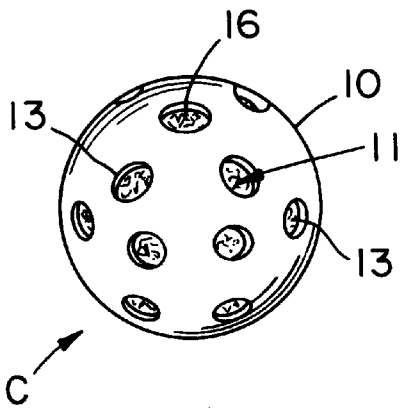
FIG. 6 is a view of another embodiment of a compound ball of the invention, as developed for providing a training golf ball of size closely approximating a regulation golf ball, and with its outer shell being cut away for illustrative purposes.

Referring to FIGS. 6 and 7, compound balls of a golf ball size are identified as embodiment C. Such embodiment, even though of smaller scale than the baseball size version A, similarly includes an outer shell 10 and an inner shell 11, of materials like those described for embodiment A, and similarly constructed. Although outer shell 10 is formed similarly with circular apertures 13, their number may be the same (such as a total of 26 apertures), but the apertures may be dimensioned appropriately for proper contact with a golf club head 24, being for example, small enough that so that there is not likely to be introduced any error in ball direction resulting from discontinuities across the surface area of outer shell 10 and yet proportionately sized for causing a desired degree aerodynamic drag as the ball leaves the club surface, providing a reduced range but nevertheless providing a decidedly natural feel, sound and ballistic character upon being hit which is realistically simulative of a regulation golf ball. As in the case of the other embodiments, the relatively lightweight character of the new compound ball greatly minimizes the possibility of injury. It is thus extremely useful for hitting in crowded facilities or in facilities where practice play, for example, is to be conducted in the vicinity of other activities. As an example, it is of special value and utility on school sports grounds, as for training student golfers, permitting practice under realistic conditions in a location where driving a regulation golf ball would endanger persons and property.

Figure 8:
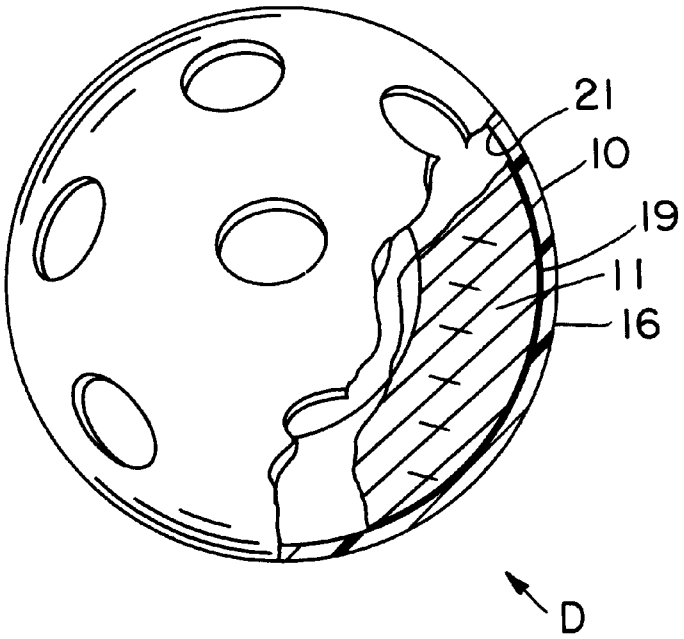
FIG. 8 is a view of another embodiment of a compound ball of the invention, its outer shell being cut away for illustrative purposes, where the outer surface of the inner shell diamentionally approaches or abuts the inner surface of the outer shell.

Referring to FIG. 8, an embodiment of a compound ball of the invention is designated as embodiment D. It similarly includes an outer ball shell 10 and inner ball or shell 11, of the materials like those described for embodiment A, and is similarly constructed, except that the outer shell 10 and the inner shell 11 are so directed as to dimensionally approach or abut one another over their entire spherical forms. In this embodiment, outer surface 16*a* of inner shell 11 dimensionally approaches inner surface 21 of outer shell 10. Although contacting for purposes of illustration, alternative forms could include air space 19 of varying size. The simulative feel of a baseball or softball is enhanced when air space 19 is radially reduced or eliminated. The radial reduction of air space 19 also imparts less aerodynamic drag on the compound ball when thrown or hit, allowing the ball to react more similarly to a regulation baseball. Embodiment D of the compound ball provides a more natural feel during throwing, catching and batting, being more simulative of a regulation softball, yet continuing in assuring against injury and inducing confidence in players, so that they rapidly progress to sport using regulation balls. So also, for batting practice, the compound ball in embodiment D according to the present disclosure increases the hitting distance of those in embodiments A, B and C.

Although outer surface 16*a* of inner shell 11 is depicted without filamentatious, a filametatious or other textured cover 16' may be provided, preferably similar to that provided and described for embodiment A, but with a thickness or average filament length which may be less than for embodiment A, or with a finish formed by texturing or other surface treatment.

Figure 9:
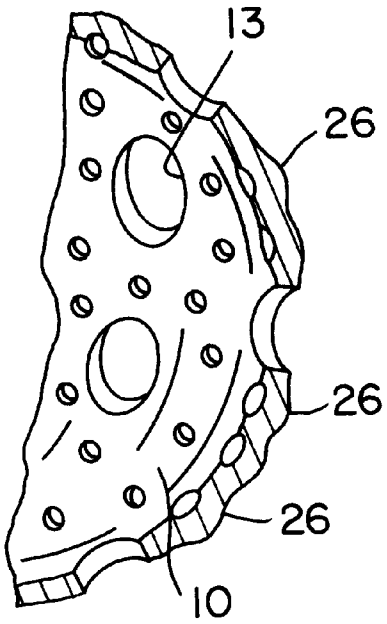
FIG. 9 is a view of another embodiment of a compound ball of the invention, where the outer surface of the outer shell contains raised external dimpling over its periphery.

Referring to FIG. 9, an embodiment of a compound ball of the invention is designated as embodiment E. It similarly includes an outer shell 10 and inner shell 11, of the materials like those described for embodiment A, and is similarly constructed, except that the outer shell 10 has raised dimpling 26 over the entirety of its external spherical periphery created, for example, during a molding process. The dimpling of the outer surface 26 of outer shell 10 can be employed on compound balls of any size, including, but not limited to, embodiments A, B and C. Although outer shell 10 is formed similarly with circular apertures 13, the dimpling may or may not affect the size and/or total number of apertures.

The effect of the exterior raised dimpling 26 of outer shell 10 adds to the usefulness of the compound ball as a teaching aide for pitching, as the dimpling will impart greater slip-resistance for the individual throwing the ball. Also, the raised dimpling 26 will impart greater aerodynamic drag on the compound ball, thus reducing its flight and limiting its range.

The following examples typify dimensional relationships appropriate for compound balls for different usages.

EXAMPLE 1

Baseball-size Compound Ball

| | Outer Shell | Inner Shell |
|---|---|---|
| Diameter | | |
| inside | 7.3 cm | 5.3 cm |
| outside | 7.0 cm | 6.4 cm |
| Circumference | 22.0 cm | 20.2 cm |
| Thickness | 0.2 cm | 0.6 cm |
| No. of apertures 26 | | |
| Aperture spacing approx. 1.4–3.0 cm | | |
| Aperture diameter 1.2 cm | | |

EXAMPLE 2

Softball Size Compound Ball

| | Outer Shell | Inner Shell |
|---|---|---|
| Diameter | | |
| inside | 9.9 cm | 7.18 cm |
| outside | 10.3 cm | 9.41 cm |
| Circumference | 29.5 cm | 27.08 cm |
| Thickness | 0.2 cm | 0.6 cm |
| No. of Apertures 26 | | |
| Aperture spacing 1.5 to 3.5 cm | | |
| Aperture diameter 1.6 cm | | |

EXAMPLE 3

Golf Ball Size Compound Ball

| | Outer Shell | Inner Shell |
|---|---|---|
| Diameter | | |
| inside | 4.0 cm | 2.9 cm |
| outside | 4.2 cm | 3.84 cm |
| Circumference | 13.4 cm | 12.3 cm |
| Thickness | 0.1 cm | 0.3 cm |
| No. of apertures 26 | | |
| Aperture spacing approx. 0.5–1.5 cm | | |
| Aperture diameter 0.85 cm | | |

NOTE: The dimensions of the Inner Shell are subject to change radially to approach the inside diameter of the Outer Shell In view of the foregoing description of the present invention and various embodiments and methods it will be seen that the several objects of the invention are achieved and other advantages are attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. A compound ball for simulating the performance of a regulation size ball for the playing of a sport, comprising an outer shell and an inner shell dimensioned to provide a spacing between the outer and inner shells, the outer shell being spherical and formed of molded polymeric material and defining circular apertures spaced over the surface of the outer shell, the inner shell being gas filled and comprised of a material capable of resiliently rebounding in response to being compressed by the outer shell upon deformation of the outer shell in response to being hit, the apertures in the outer shell permitting air to pass through the apertures when the compound ball is in flight, the inner shell providing mass and impact rebound within the outer shell for simulating the action of a regulation ball when thrown, caught, hit or impacts an object.

2. A compound ball according to claim 1 wherein the outer shell is formed of two hemispherical halves which are joined together about the inner shell.

3. A compound ball according to claim 1 wherein the inner shell is movable within the outer shell when the compound ball is thrown, caught, hit or impacts an object.

4. A compound ball according to claim 3 wherein the outer shell can be resiliently deformed when hit or upon impact for compressing and resiliently deforming the inner shell in turn, the inner shell resiliently resisting such impact with spring-like characteristic.

5. A compound ball according to claim 1 wherein the outer shell when first contacted when hit by a club or bat provides an audibly recognizable sound of hitting a regulation ball.

6. A compound ball according to claim 1 wherein the inner shell includes a cover of filamentatious material providing filaments which at least partly fill the spacing between the inner and outer shells.

7. A compound ball according to claim 6 wherein the inner shell floats within the outer shell and said filaments tend to support the inner shell within the outer shell.

8. A compound ball according to claim 1 wherein the inner shell approaches or abuts the outer shell over the entirety of its inner surface.

9. A compound ball according to claim 8 wherein the outer shell can be resiliently deformed when hit or upon impact for compressing and resiliently deforming the inner shell in turn, the inner shell resiliently resisting such impact with spring-like characteristic.

10. A compound ball according to claim 1 wherein the outer shell contains raised dimpling across its periphery.

* * * * *

UNITED STATES PATENT AND TRADEMARK OFFICE

CERTIFICATE OF CORRECTION

PATENT NO. : 6,012,997
DATED : January 11, 2000
INVENTOR(S) : Mason

It is certified that error appears in the above-identified patent and that said Letters Patent is hereby corrected as shown below:

On title page item [57],

In the Abstract, line 10, the word "trough" should be --through--;

Col. 1, line 39, delete "that it" (repeated twice);

Col. 3, line 14, the word "trough" should be --through--;

Col. 5, line 8, the word "Examplarily" should be -- Exemplarily --.

Col. 6, line 25, the word "intimated" should be --intimidated--;

line 66, the word "plays" should be --players--;

Col. 7, line 13 insert --be-- after the word "can";

Signed and Sealed this

Second Day of January, 2001

*Attest:*

*Attesting Officer*

Q. TODD DICKINSON

*Commissioner of Patents and Trademarks*